United States Patent [19]

Kasamatsu et al.

[11] Patent Number: 4,570,169

[45] Date of Patent: Feb. 11, 1986

[54] HEAT-SENSITIVE RECORDING MATERIALS

[75] Inventors: Norikazu Kasamatsu, Kawasaki; Masao Matsukawa; Masaru Mishima, both of Tokyo, all of Japan

[73] Assignee: Sanyo-Kokusaku Pulp Co., Ltd., Tokyo, Japan

[21] Appl. No.: 647,394

[22] Filed: Sep. 5, 1984

[30] Foreign Application Priority Data

Sep. 27, 1983 [JP] Japan ..... 58-177093

[51] Int. Cl.[4] ..... B41M 5/18

[52] U.S. Cl. ..... 346/200; 346/226; 427/152

[58] Field of Search ..... 346/200, 226, 208, 209, 346/214, 218, 221, 224; 427/150, 151, 152

[56] References Cited

U.S. PATENT DOCUMENTS 4,311,750 1/1982 Kubo et al. ..... 427/150

*Primary Examiner*—Bruce H. Hess

*Attorney, Agent, or Firm*—Oblon, Fisher, Spivak, McClelland & Maier

[57] ABSTRACT

A heat-sensitive recording material composed of a heat-sensitive, color-forming layer on a sheet substrate. The heat-sensitive, color-forming layer is mainly composed of a color-forming component consisting of a colorless or light-colored leucodye and an acidic compound for allowing said leucodye to develop color by heating, and further includes on the upper surface thereof a protective layer composed mainly of a polyvinyl alcohol and containing an epoxy compound having in its molecule at least two epoxy groups or an ethylenimine compound having in its molecule at least two ethylenimine groups.

11 Claims, No Drawings

HEAT-SENSITIVE RECORDING MATERIALS

FIELD OF THE INVENTION

The present invention relates to a heat-sensitive recording material comprising a supporting or backing layer and a heat-sensitive, color-forming layer contained in the surface thereof, said color-forming layer being mainly composed of a colorless or light-colored leucodye and an acidic compound for allowing said leucodye to develop color by heating, and primarily characterized by including therein a protective layer.

BACKGROUND OF THE INVENTION

So far, the heat-sensitive recording sheets including a sheet substrate and a heat-sensitive, color-forming layer contained in the surface thereof, said color-forming layer being mainly composed of a colorless or light-colored leucodye and an acidic compound for allowing said leucodye to develop color by heating, have widely been used for facsimiles, and printers for electronic computers and measuring instruments, and attempts have been made to produce heat-sensitive, color-forming adhesive labels based on said recording sheets. Since the printing system used relies upon a thermal head, such adhesive labels are advantageous in that clear printed images of an excellent resolution are easily obtained, compared with the those in conventional impact printing systems using ink or ink ribbons. However, this type of heat-sensitive recording paper offers a problem that, when the plasticizer contained in stretch wrapping films penetrates into the heat-sensitive, color-forming layer, the developed color. It is thus impossible to apply that recording paper as a label to be used for the stretch wrapping film-packaged. In the heat-sensitive, color-forming adhesive labels for the stretch wrapping film-packaged articles, therefore, proposals have been made to provide a protective layer on the heat-sensitive, color-forming layer thereof to prevent penetration of the plasticizer into that layer (Japanese Patent Laid-Open Publication Nos. 54-128347 and 54-3594). Furthermore, it has been proposed to use as the main ingredient of the aforesaid protective layer a water-soluble polymer substance such as, for instance, polyvinyl alcohol or its modified products and starch or its modified products (Japanese Patent Laid-Open Publication Nos. 56-126193 and 56-139993).

With the heat-sensitive, color-forming adhesive labels including a protective layer composed mainly of such a water-soluble polymer substance, however, the thickness of that protective layer should be increased, since, by using only a water-soluble polymeric substance, it is difficult to sufficiently prevent penetration of plasticizers into the heat-sensitive, color-forming layer thereof. In addition, when being developed by a thermal head, there occurs certain problems caused by the thicker protective layer. For instance lowering of heat sensitivity, residue build-up and sticking. Thus, there is still left a great deal of performance improvement for practical use.

SUMMARY OF THE INVENTION

In view of the foregoing problems, a main object of the present invention is to provide a heat-sensitive recording material which prevents a printed image from color disappearing due to a wrapping film ingredient such as plasticizer yields a good printed image by thermal head without residue build-up and sticking.

According to the present invention, this object is achieved by providing a protective layer composed mainly of a polyvinyl alcohol and containing an epoxy compound and/or an ethylenimine compound on a heat-sensitive, color-forming layer including as the color-forming compounds a colorless or light-colored leucodye and an acidic compound for allowing said leucodye to develop color by heating. According to the present invention, a good printed image is obtained without lowering heat sensitivity, residue build-up and sticking. Also, the obtained image is free of the problem of color disappearance.

DETAILED DESCRIPTION OF THE INVENTION

The epoxy or ethylenimine compound to be added to the polyvinyl alcohol in the present invention is a multifunctional one having at least two epoxy or ethylenimine groups in its molecule, and is capable of cross-linking the polyvinyl alcohol, thereby reducing the thickness of the protective layer to the minimum required.

The heat-sensitive recording material of the present invention will now be explained in further detail.

As well known in the art, there are a number of polyvinyl alcohols in respect of the degree of saponification and polymerization. More specifically, there are known polyvinyl alcohols which are partially (a saponification degree of about 80%) or entirely saponified (a saponification degree of 98% or more) and which have a polymerization degree of 500 to 2000. Furthermore, modified polyvinyl alcohols such as carboxyl-modified polyvinyl alcohols are known in the art. These polyvinyl alcohols may be used or in combination as the main component of the protective layer according to the present invention.

It is a requisite for the present invention that the epoxy or ethylenimine compound to be added to the polyvinyl alcohol contains at least two epoxy or ethylenimine groups in its molecule respectively. The structural formulae of typical epoxy and ethylenimine compounds are given below for the purpose of illustration alone

| | Structural Formulae |
|---|---|
| Epoxy Compounds | |
| 1 | 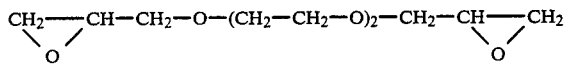 |
| 2 | 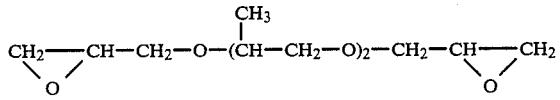 |

-continued
| | Structural Formulae |
|---|---|
| 3 | 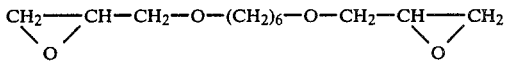 |
| 4 | 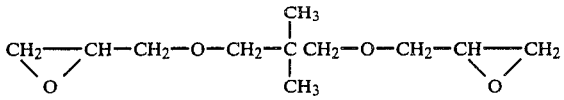 |
| 5 | 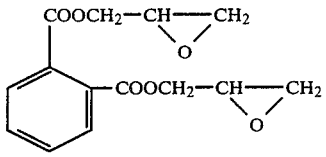 |
| 6 | 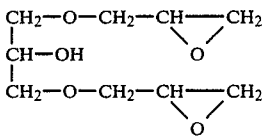 |
| 7 | 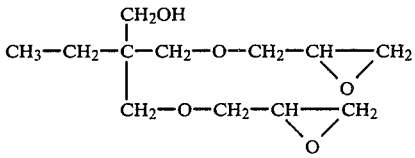 |
| 8 | 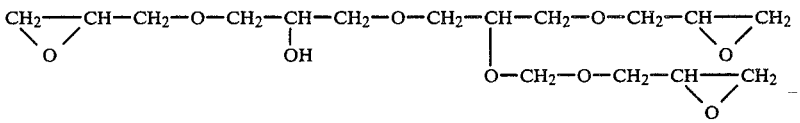 |
| 9 | 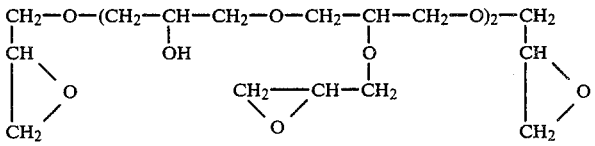 |
| 10 | 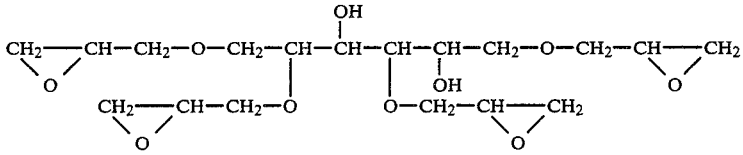 |
Ethylenimine Compounds
| No. | |
|---|---|
| 1 | 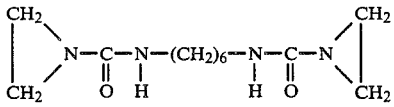 |
| 2 | 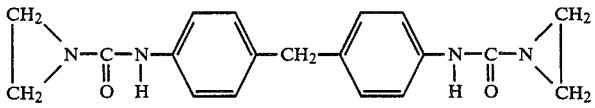 |

-continued

| | Structural Formulae |
|---|---|
| 3 | 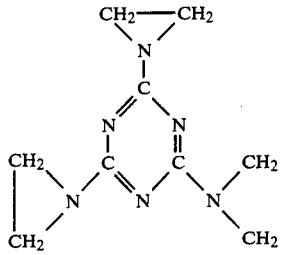 |
| 4 | 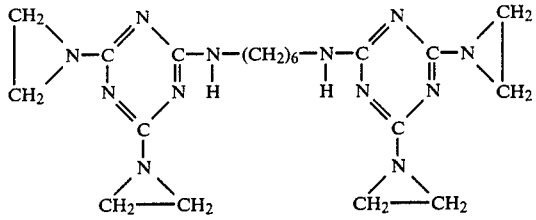 |
| 5 | 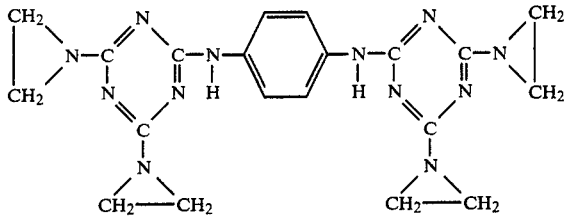 |
| 6 | 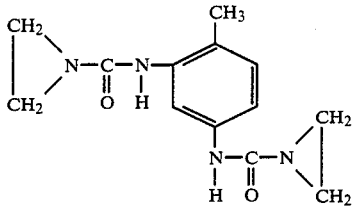 |
| 7 | 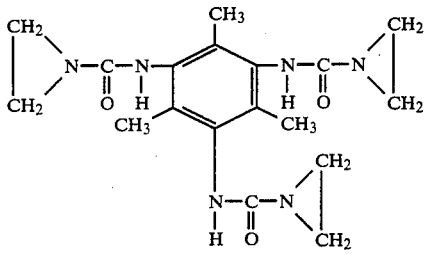 |

In order to form the protective layer according to the present invention, at least one of the epoxy or ethylenimine compounds is added to the polyvinyl alcohol, and coated onto the heat-sensitive, color-forming layer, optionally with the use of a suitable solvent, followed by drying. Drying should be carried out at a temperature that is lower than the color-forming temperature of the heat-sensitive, color-forming layer.

It is preferred that 0.05–1 part by weight, more particularly 0.1–0.5 parts by weight, of the epoxy or ethylenimine compound is added to 1 part by weight of the polyvinyl alcohol. The amount of coating with respect to the protective layer is preferably in a range of 0.5 to 5.0 g/m$^2$. An amount of coating exceeding 5.0 g/m$^2$ causes a lowering in the heat sensitivity of the heat-sensitive, color-forming layer, while an amount of coating of less than 0.5 g/m$^2$ results in poor uniformity of the protective layer. The heat-sensitive, color-forming layer may be formed in the known coating manner. As the substrates, the sheet material such as paper, synthetic paper or plastic films, may be applicable. Onto one surface of the substrate is coated a coating liquid containing a leucodye, an acidic compound for allowing said leucodye to develop color by heating and a binder, thereby forming a heat-sensitive, color-forming layer. The components of the heat-sensitive color-forming layer are exemplified below.

(1) Leucodye

Use may be made of various colorless or light-colored leucocompounds.

i. Triphenylmethane based dyes 3,3-bis(p-dimethylaminophenyl)-phthalide 3,3-bis(p-dimethylaminophenyl)-6-dimethylaminophthalide (or crystal violet lactone)
3,3-bis(p-dimethylaminophenyl)-6-diethylaminophthalide
3,3-bis(p-dimethylaminophenyl)-6-chlorophthalide
3,3-bis(p-dibutylaminophenyl)phthalide (or malachite green)

ii. Fluoran based dyes 3-dimethylamino-6-methoxyfluoran
3-dimethyl-6-methyl-7-chlorofluoran
3-dimethylamino-5-methyl-7-dibenzylaminofluoran
3-diethylamino-7-chlorofluoran
3-diethylamino-7-methoxyfluoran
3-diethylamino-7-dibenzylaminofluoran
3-diethylamino-7-(N-methylanilino)fluoran
3-diethylamino-7-0-chloroanilinofluoran
3-diethylamino-7,8-benzfluoran
3-diethylamino-6-methyl-7-chlorofluoran
3-diethylamino-6-methy-7-anilinofluoran
3-diethylamino-6-methyl-7-p-butyl anilinofluoran
3-diethylamino-5-methyl-7-dibenzylaminofluoran
3-ethyl-6-methyl-7-anilinofluoran
2-anilino-6-diethylaminofluoran
3-(N-methyl-N-cyclohexylamino)-6-methyl-7-anilinofluoran iii. Phenothiazine based dyes benzoyl leucomethylene blue
2,2-dimethyl deucomethylene blue
p-anisoyl leucomethylene blue
N-pivalyl leucomethylene blue iv. rhodamine lactam base dyes N-phenylrhodamine-$\beta$-lactam
amiderhodamine-$\beta$-saltone v. Spiro-pyran based dyes benzo-$\beta$-haphthospiro-pyran
1,3,3-trimethyl-6'-chloro-8'-methoxy-indolino-benzospiro-pyran 2. Acidic Compound The acidic compounds for allowing the leucodye to develop color by heating include:

i. Inorganic and organic acids

Boric acid, oxalic acid, maleic acid, tartaric acid, citric acid, succinic acid, benzoic acid, stearic acid, gallic acid, salicylic acid, 1-hydroxy-2-naphthonic acid, o-hydroxybenzoic acid, m-hydroxybenzoic acid, 2-hydroxy-p-toluic acid.

ii. Phenolic substances 4-4'-isopropylidenediphenol (bisphenol A)
4-4'-isopropylidene-bis(2-chlorophenol)
4-4'-isopropylidene-bis(2-methylphenol)
4-4'-isopropylidene-bis(2-tert-butylphenol)
4.-4'sec-butylidenediphenol
4-tert-butylphenol
4-tert-octylphenol
4-tert-octylcatecol
4-phenylphenol(p-phenylphenol)
4-hydroxydiphenoxide
2,2'-dihydroxydiphenol
$\alpha$-naphthol
$\beta$-naphthol
methyl-4-hydroxybenzoate
benzyl-4-hydroxybenzoate
ethyl-4-hydroxybenzoate
propyl-4-hydroxybenzoate
4-hydroxy-acetophenol 3. Binders The binders for bonding the heat-sensitive, color-forming layer onto the sheet substrate include:
polyvinyl alcohol
starch or its modified product or derivative
methylcellulose
hydroxyethylcellulose
carboxymethylcellulose
gum arabic
gelatin
casein
polyvinyl pyrrolidone
polyacrylamide
polyacrylic acid salt
styrene/maleic anhydride copolymer
isobutylene/maleic anhydride copolymer
styrene/butadiene copolymer
polyvinyl acetate
polyacrylic ester If required, the heat-sensitive, color-forming layer may contain known auxiliary additives, for instance, fine white pigments such as calcium carbonate, talc, clay, silica, titanium oxide and urea formalin resin and/or heat fusible substances such as various waxes, metal salts of higher fatty acid, and higher fatty acid amides to improve the printed image quality.

The thus obtained heat-sensitive recording material according to the present invention excels in the recording properties and the protecting properties of the heat-sensitive, color-forming layer, without residue build-up and sticking. Furthermore, the heat-sensitive, color-forming adhesive label obtained by applying adhesives onto the other surface of the sheet substrate of the invented heat-sensitive recording material is more excellent than ever.

While the present invention will not be explained with reference to several examples, it is understood that the invention is not limited thereto.

EXAMPLE 1

The following component were mixed together for 24 hours in a ball mill to prepare dispersions A and B.

| | parts by weight |
|---|---|
| Dispersion A | |
| 3-diethylamino-7-o-chloroanilinofluoran | 1.0 |
| 20% polyvinyl alcohol | 5.0 |
| water | 44.0 |
| dispersion B | |
| bisphenol A | 4.0 |
| calcium carbonate | 3.0 |
| stearamide | 1.0 |
| 20% polyvinyl alcohol | 10.0 |
| water | 32.0 |

The dispersions A and B were mixed together to form a coating liquid for a heat-sensitive, color-forming layer, which was coated onto one surface of wood free paper (basis weight 50 g/m$^2$), followed by drying, thereby preparing a heat-sensitive, color-forming layer in a coating amount of 7 g/m$^2$. The following liquid C was then coated onto the heat-sensitive, color-forming layer, followed by drying, thereby forming a protective layer in a coating amount of 2 g/m$^2$. In this manner, the heat-sensitive recording material according to the present invention was obtained.

| Liquid C | parts by weight |
|---|---|
| polyvinyl alcohol | 5.0 |
| glycerol polyglycidyl ether (epoxy compound No. 6) | 1.0 |
| water | 94.0 |

EXAMPLE 2

After a heat-sensitive, color-forming layer had been prepared according to the procedures of Example 1, the following liquid D was coated thereto, followed by drying, thereby forming a protective layer in a coating amount of 2 g/m$^2$. In this manner, the heat-sensitive recording material according to the present invention was obtained.

| Liquid D | parts by weight |
|---|---|
| polyvinyl alcohol | 5.0 |
| diphenylmethane-bis-4,4'-N.N'—diethylene urea (ethylenimine compound No. 2) | 1.0 |
| water | 94.0 |

COMPARATIVE EXAMPLE 1

The procedures of Example 1 were repeated, provided that no protective layer was formed, to prepare the heat-sensitive recording material as the first control.

COMPARATIVE EXAMPLE 2

The procedure of Example 1 were repeated, provided that the following liquid E was used for a protective layer, to obtain the second control heat-sensitive recording material.

| Liquid E | parts by weight |
|---|---|
| polyvinyl alcohol | 5.0 |
| water | 95.0 |

COMPARATIVE EXAMPLE 3

The procedure of Example 1 was repeated, provided a considerably high coating amount for a protective layer was 6.0 g/m$^2$, to obtain the third control heat-sensitive recording material.

The foregoing recording materials were printed by means of a label printer (HP-9303 manufactured by Tokyo Denki K.K.), and covered with a polyvinyl chloride (PVC) wrapping film to compare the optical density before covering and after the lapse of 24 hours (Densitometer Macbeth RD-514). The results are set forth in table. From the table, it is found that both the samples according to Examples 1 and 2 showed no residue build-up and no sticking when printed. And the good printed image having the optical density of higher than 1.1 was obtained. After covering with a polyvinylchloride film the decrease amount of optical density was within 0.05. However, although Comparative Example 1 and 2 gave good printed images as in Example 1 and 2, the decrease amount of optical density PVC film covering was as large as 0.7 so that the images of control samples were difficult to be read. Referring to Comparative Example 3, although the decrease of optical density after PVC film covering was within 0.05, the control sample showed residue build-up and sticking. Before PVC film covering, the optical density was 0.7.

TABLE

| Samples | Optical density of the printed image: Before PVC film covering | Optical density of the printed image: After PVC film covering | Residue build-up, & sticking |
|---|---|---|---|
| Ex. 1 | 1.15 | 1.12 | |
| Ex. 2 | 1.15 | 1.13 | |
| Compara. Ex. 1 | 1.20 | 0.35 | |
| Compara. Ex. 2 | 1.14 | 0.45 | |
| Compara. Ex. 3 | 0.70 | 0.66 | X |

Extremely Good
Good
X Bad

As mentioned above, when the protective layer composed mainly of a polyvinyl alcohol and containing an epoxy or ethylenimine compound is applied onto the heat-sensitive, color-forming layer, a good printed image is obtained without residue build-up and sticking, and maintained over an extended period. However, such good performances as obtained in the present invention can not be achieved with the absence of the aforesaid protective layer or the use of the conventional protective layer.

What is claimed is:

1. A heat-sensitive recording material, composed of:

a heat sensitive, color forming layer on a sheet substrate, said layer being mainly composed of a color forming component consisting of a colorless or light-colored leucodye and an acidic compound which promotes the development of color by said leucodye upon heating, and a topmost protective layer over said color-forming layer, said protective layer being composed mainly of a polyvinyl alcohol and an epoxy compound having in its molecule at least two epoxy groups or an ethylene imine comound having in its molecule at least two ethylene imine groups.

2. The heat-sensitive recording material of claim 1, wherein the amount of the epoxy compound in said protective layer is 0.05 to 1.0 part by weight per part of said polyvinyl alcohol.

3. The heat-sensitive recording material of claim 2, wherein the amount of said epoxy compound ranges from 0.1–0.5 parts by weight.

4. The heat-sensitive recording material of claim 1, wherein the amount of the ethylene imine compound in said protective layer is 0.05 to 1.0 part by weight per part of of said polyvinyl alcohol.

5. The heat-sensitive recording material of claim 4, wherein the amount of said ethylene imine compound ranges from 0.1–0.5 parts by weight.

6. The heat-sensitive recording material of claim 1, wherein said polyvinyl alcohol is partially saponified to a saponification degree of about 80%, said polyvinyl alcohol is essentially entirely saponified to a saponification degree of at least 98%, or said polyvinyl alcohol is a carboxyl group modified polyvinyl alcohol.

7. The heat-sensitive recording material of claim 6, wherein said polyvinyl alcohol has a polymerization degree of 500 to 2000.

8. The heat-sensitive recording material of claim 1, wherein the amount of said protective layer provided over said color-forming layer ranges from 0.5 to 5.0 $g/m^2$.

9. The heat-sensitive recording material of claim 1, wherein said leucodye is a triphenylmethane based dye, a fluoran based dye, a phenothiazine based dye or a spiro-pyran based dye.

10. The heat-sensitive recording material of claim 1, wherein said color-forming layer further comprises a binder.

11. The heat-sensitive recording material of claim 10, wherein said color-forming layer further comprises a fine white pigment, a urea formalin resin, a heat fusable substance, or mixtures thereof.

* * * * *